US005090326A

United States Patent [19]

Altenau et al.

[11] Patent Number: 5,090,326

[45] Date of Patent: Feb. 25, 1992

[54] LIGHTWEIGHT TRAINING BOMBLET EQUIPPED WITH AXIALLY TENSIONED HOUSING COVERS

[75] Inventors: Ernst-Wilhelm Altenau, Duisburg; Ulf Hahn, Ratingen; Siegmar Fischer; Margret Palten, both of Düsseldorf, all of Fed. Rep. of Germany

[73] Assignee: Rheinmetall GmbH, Düsseldorf, Fed. Rep. of Germany

[21] Appl. No.: 642,463

[22] Filed: Jan. 17, 1991

[30] Foreign Application Priority Data

Jan. 22, 1990 [DE] Fed. Rep. of Germany ..... 4001673

[51] Int. Cl.[5] ..... F42B 12/36; F42B 8/12

[52] U.S. Cl. ..... 102/395; 102/334; 102/393; 102/489; 102/513

[58] Field of Search ..... 102/334, 340, 342, 345, 102/351, 352, 357, 360, 393, 395, 465, 466, 467, 469, 473, 489, 498, 505, 513

[56] References Cited

U.S. PATENT DOCUMENTS

| | | | |
|---|---|---|---|
| 174,325 | 2/1876 | Tyler | 102/473 |
| 3,049,080 | 8/1962 | Schermuly | 102/357 |
| 3,323,456 | 6/1967 | Rothman | 102/357 |
| 3,759,216 | 9/1973 | Sander et al. | 102/334 |
| 4,444,111 | 4/1984 | Luebbers | 102/334 |
| 4,620,484 | 11/1986 | Livne | 102/395 |
| 4,791,870 | 12/1988 | Simpson | 102/342 |
| 4,869,174 | 9/1989 | Hanser et al. | 102/489 |

FOREIGN PATENT DOCUMENTS

| | | | |
|---|---|---|---|
| 498458 | 1/1920 | France | 102/395 |
| 7902833 | 10/1980 | Netherlands | 102/498 |

*Primary Examiner*—Harold J. Tudor
*Attorney, Agent, or Firm*—Spencer & Frank

[57] ABSTRACT

A lightweight training bomblet provided with a housing made of cardboard or plastic. Such training bomblet should be easily assembled and be able to withstand the high acceleration forces generated during transport into a target area. To prevent undue deformations of the bomblet housings made, for example, of cardboard, during air transport and the resulting premature ignition during ejection from a carrier projectile, both cardboard or plastic housing covers are connected with one another by means of a pre-tensioned connecting arrangement and their abutment faces are pressed against the end faces of a tubular housing shell, with the abutment faces of the housing covers possibly additionally containing a holding and sealing arrangement which is pressed into or against the end faces of the housing shell. Preferably the holding and sealing arrangement is composed of an annular blade member which is cylindrical on its exterior surface and conical on its interior surface, thus providing, in the assembled state of the bomblet, high stability of the tubular housing shell and a good sealing effect. The connecting arrangement for the housing covers may be composed of an axially disposed screw connection in which a delayed ignition charge is disposed in a space saving manner.

18 Claims, 4 Drawing Sheets

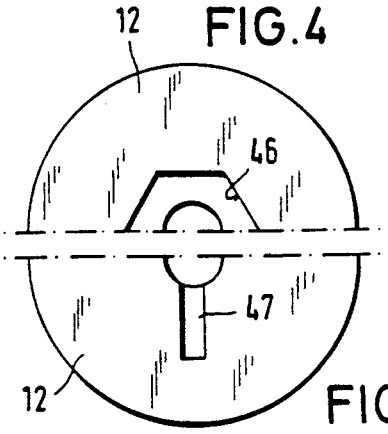
FIG.4
FIG.5
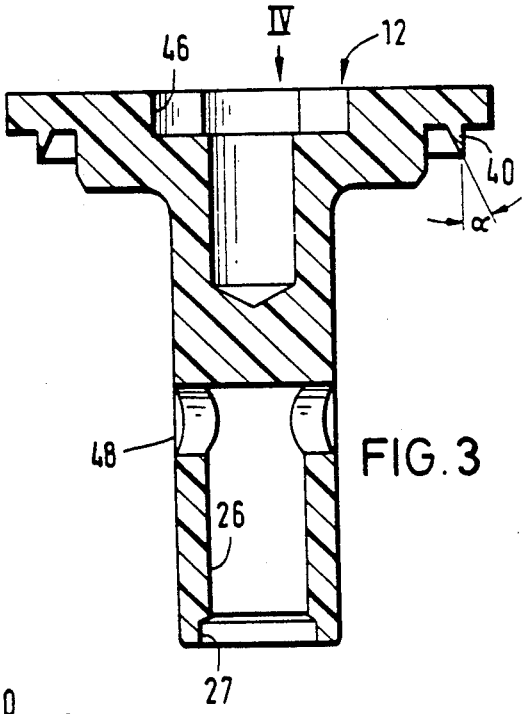
FIG.3
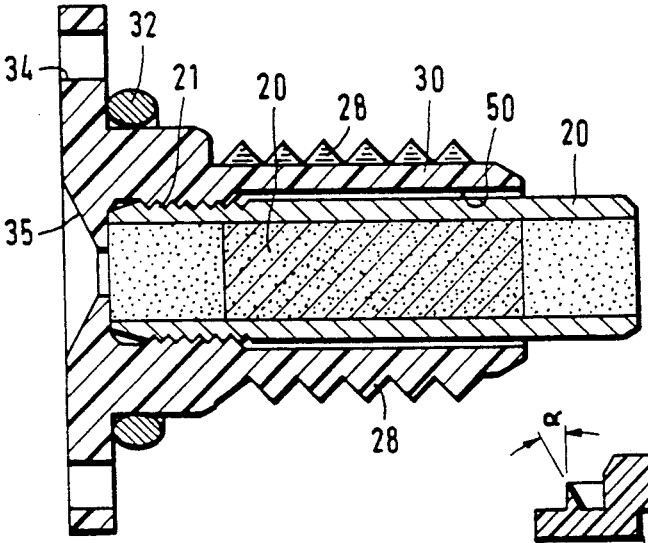
FIG.6
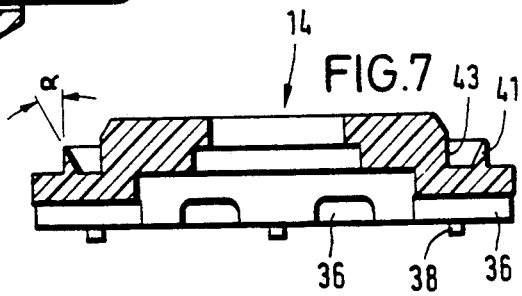
FIG.7
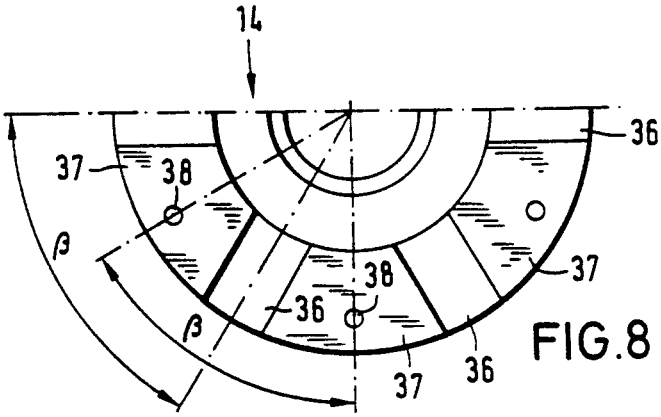
FIG.8

LIGHTWEIGHT TRAINING BOMBLET EQUIPPED WITH AXIALLY TENSIONED HOUSING COVERS

BACKGROUND OF THE INVENTION

1. Field of the Invention

The present invention relates to a training bomblet including a tubular cardboard or plastic housing shell which is closed on both sides by means of centered cardboard or plastic housing covers so as to fix a signature charge at both its end faces, with one housing cover accommodating a delayed ignition charge.

2. Background Information

Lightweight training bomblets of this type have been proposed in German Patent Application P 39 34 362.6 and the corresponding U.S. patent application Ser. No. 07/597,337 filed 10/15/90. These training bomblets are carried into a target area by a carrier projectile. Their lightweight construction prevents them from sinking into the ground when they land on yielding surfaces so that they leave the desired ground signature. Moreover, training bomblets of this type should be easy to assemble and, during transport into the target area, should be able to withstand high acceleration forces.

A drawback of the prior art solutions is that with bomblet housing covers made of cardboard, off-center installation of the training bomblets in the carrier projectile and the resulting centrifugal forces cause deformations which, during ejection from the carrier projectile, may lead to premature ignition of the bomblets while still within the carrier projectile.

SUMMARY OF THE INVENTION

It is therefore an object of the present invention to provide a training bomblet with improved stability, while ensuring easy assembly and manufacture, thereby avoiding undue deformations during air transport and resulting premature ignition of the training bomblets during ejection from a carrier projectile.

The above object is generally accomplished according to the present invention by a training or practice bomblet comprising: a tubular housing shell formed of cardboard or plastic; first and second housing covers, each formed of cardboard or plastic, centered on and closing respective opposite ends of the tubular housing shell, with the covers having respective abutment faces which contact respective end faces of the shell; a signature charge disposed in the shell and fixed at both end faces thereof by the covers; a delayed ignition charge accommodated by one of the housing covers; and a pretensioned connecting means for connecting the covers together and for pressing the abutment faces against respective end faces of the tubular housing shell.

In an advantageous manner, the present invention provides for a connection which supplies axial tension to the two cardboard or plastic housing covers and presses the cover abutment faces against the end faces of the housing shell. This ensures high stability of the tubular housing shell and a good sealing effect against the ignition flame required to ignite the delayed ignition charge and acting on the training bomblets from the outside during the ejection.

According to another aspect of the invention, the sealing and stability imparting effect may be augmented by the provision of a holding and sealing structure at each cover abutment face which is pressed into or against the end faces of the housing shell.

According to another aspect of the invention, a stable connection is produced between each housing cover and the housing shell, for example a cardboard tube, by providing a cover projection which extends into the housing shell and additionally by providing the holding and sealing structure configured as an annular blade member which presses itself during assembly into or against the respective end face of the housing shell. The blade member may have various different shapes. In a preferred embodiment, it is configured so that its exterior edge, with respect to the tubular housing shell, is parallel to the axis of the tubular housing shell, while its interior edge has a small-angle wedge shape. In this configuration, the housing shell region disposed between the blade member and the cover projection is additionally squeezed together. When the blade member is pressed into the end face of the housing shell, the cylindrical outer contour of the blade member prevents a change in the outer diameter of the housing shell. Thus, the tubular housing shell is easily fixed on both sides in a stable manner and a labyrinth-type seal is obtained which has a high sealing effect.

According to another aspect of the invention, when pressed against the housing shell, both housing covers are held together by an axial screw or snap-in connection. The screw of the screw connection is configured in such a way that it receives a pyrotechnic delay element in a space saving manner, while the counter-element is configured as a hollow screw equipped with an internal thread and, in order to ignite the signature charge, is provided with a transverse bore to permit the flame of the delay element to exit. This counter-element may advantageously also be connected in one piece with one of the housing covers and thus may be configured, for example, as a single injection molded plastic piece, simplifying manufacture. It is also possible to encase a metal counter-element in a plastic housing cover or to configure it in such a way that it can be pushed through the housing cover while a fastening projection on the counter-element rests in an exterior depression of the housing cover.

The screw for receiving the delay unit may be made of metal or plastic, with the insertion of diecast components being possible. The metal screw may have a self-cutting external thread so that, if the counter-element is connected in one piece with a plastic cover, the separate manufacture of the internal thread can be eliminated in an advantageous manner.

The housing cover receiving the delay unit is provided with several, preferably six, radial grooves which conduct hot ejection gases to the delay element and thus ignite it. In this housing cover, small cams are additionally provided on the lands between the grooves. These cams are compressed more or less, depending on the position tolerance of the individual bomblets, when the latter are installed into the carrier projectile, and thus ensure a firm axial seat for the bomblets in the carrier projectile.

The training bomblet according to the present invention is composed of easily manufactured components which are easily and economically assembled, thus keeping manufacturing costs extremely low.

The present invention will now be described in greater detail with reference to two embodiments thereof that are illustrated in the drawing figures.

BRIEF DESCRIPTION OF THE DRAWINGS

FIG. 3 is a sectional view of the counter-element connected with one of the housing covers.

FIGS. 4 and 5 are views in the direction marked IV in FIG. 3.

FIG. 6 is an enlarged view of the screw shown in FIG. 1 for accommodating a delayed charge.

FIG. 7 is a cross-sectional view of the housing cover accommodating the screw.

FIG. 8 is a view in the direction marked VIII in FIG. 1.

DETAILED DESCRIPTION OF THE PREFERRED EMBODIMENT(S)

Figure 1:
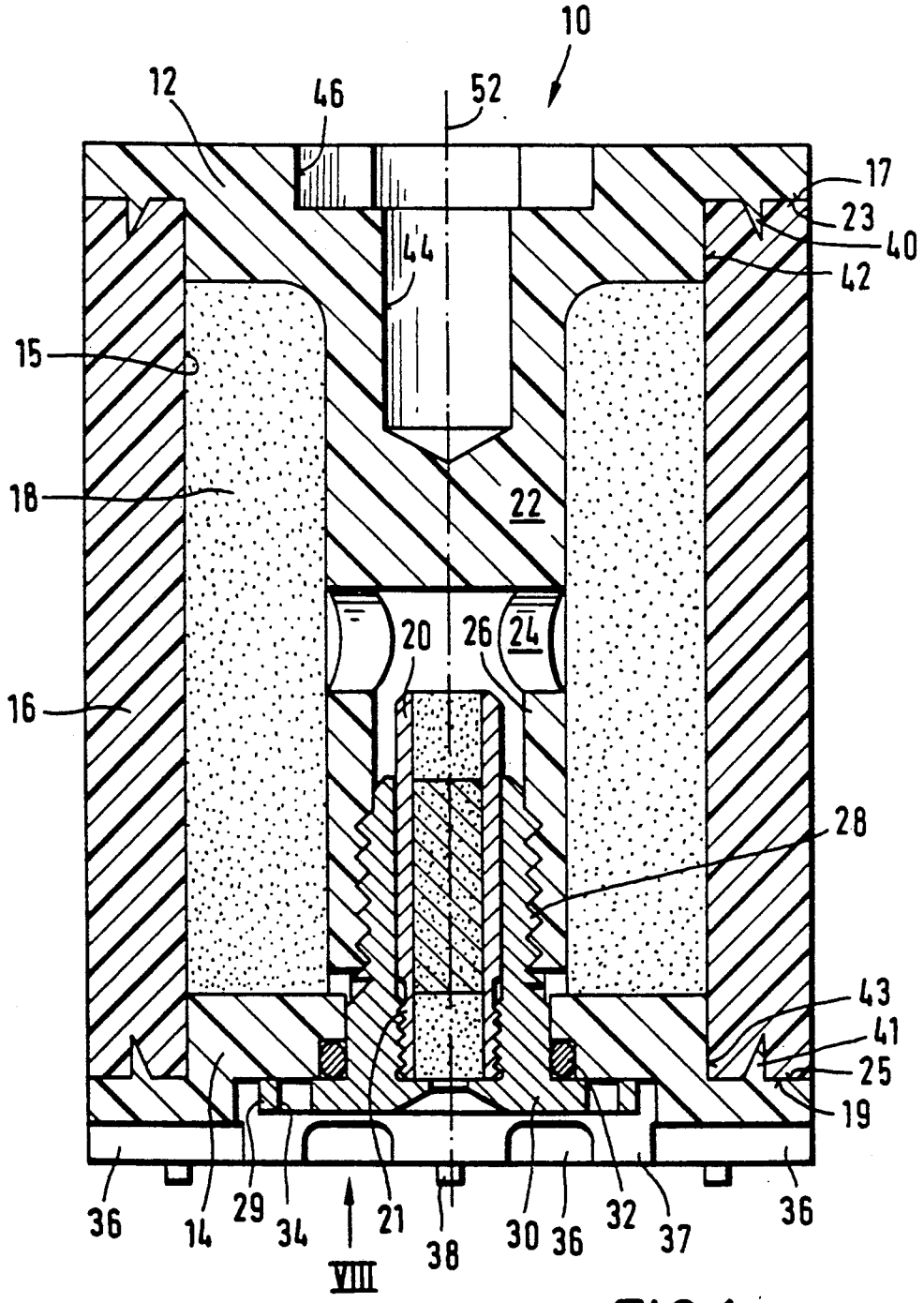
FIG. 1 is a cross-sectional view of a lightweight training bomblet according to the invention including a screw connection which holds the housing covers together, with the counter-element for the screw connection being connected in one piece with one of the housing covers.
Figure 2:
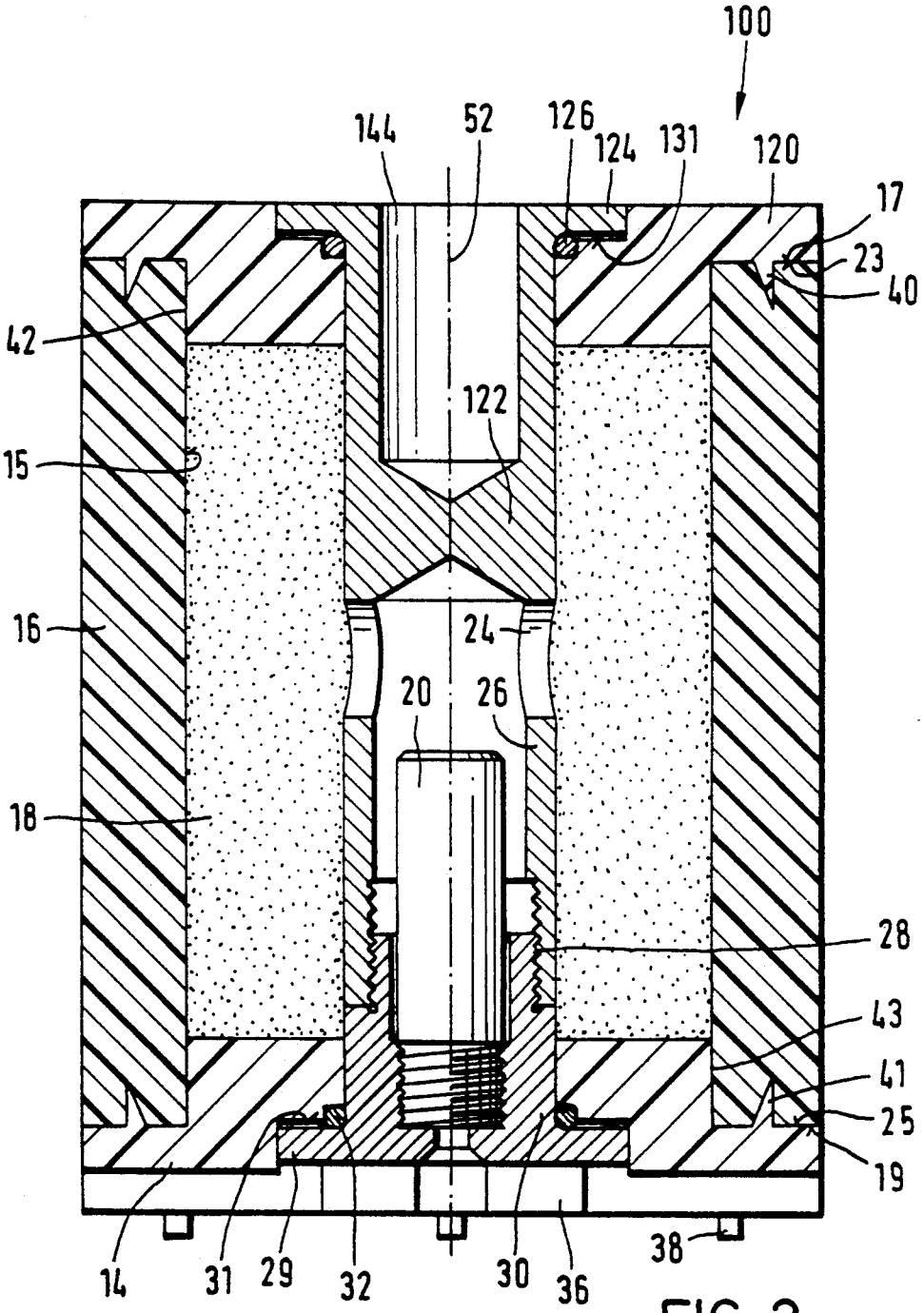
FIG. 2 is a cross-sectional view of a lightweight training bomblet according to the invention in which the counter-element of the screw connection and the housing cover constitute separate components.

In FIGS. 1 and 2, the reference numerals 10 and 100, each identify a respective lightweight training bomblet which includes a tubular cardboard or plastic housing shell 16 that is closed on both sides by cardboard or plastic housing covers 12, 14, 120 which are centered in the interior of the housing shell 16. The housing shell 16 of FIGS. 1 and 2 enclosed a signature charge 18 which is fixed on both end faces by housing covers 12, 14 and 14, 120, respectively. Signature charge 18 is ignited with a time delay by a known delayed ignition charge 20 after this delayed ignition charge has been ignited.

The two covers of each pair of cardboard and plastic housing covers 12, 14 and 14, 120, respectively, are connected with one another by means of a respective tension producing connecting means 22, 30, 30, 122, respectively. Housing covers 12, 14 and 14, 120 are provided with abutment faces 23, 25, respectively, which are pressed against the adjacent respective end faces 17, 19 of the tubular housing shell 16 and are provided with holding and sealing means 40, 41 which are pressed into or against the end faces 17, 19 of housing shell 16.

Each holding and sealing means 40, 41 is composed of an annular blade-like member which has a cylindrical shape extending parallel to the longitudinal axis of shell 16 on its exterior side and a conical shape on its interior side tapering toward a cutting edge.

In order to provide for a tight fit in end faces 17, 19 and pressure against their outer edges, wedge angle $\alpha$ (FIG. 3) of blade member 40, 41 is made relatively small and may be, for example, between 5 and 35 degrees.

At a right angle to abutment faces 23, 25, each housing cover 12, 14, 120 is provided with a projection 42, 43 which is centered by an internal bore 15 in tubular housing shell 16 and has a greater axial length than the respective blade member 40, 41. Thus, when a blade member 40, 41 is pressed into an face 17, 19, the, preferably, cardboard material of housing shell 16 is compressed and supported in the region of the internal bore 15 of the shell 16 by the respective cover projection 42, 43.

The connecting means 22, 30 and 30, 122, respectively, which hold housing covers 12, 14 and 14, 120, respectively, on housing shell end faces 17, 19 are composed of a screw or snap-in connection disposed on the longitudinal axis 52 of the bomblet.

Each connection 22, 30 or 30, 122 is composed of a respective connecting element or screw 30 accommodating the delayed ignition charge 20 and a counter-element 22 or 122 that can be screwed together with it. Each counter-element 22, 122 includes a blind longitudinal bore 26 which is closed on one side by screw 30 and opens on the other side into a transverse bore 24, with the delayed ignition charge 20 projecting into longitudinal bore 26.

In order to establish the screw connection 22, 30 or 122, 30, an external thread 28 of screw 30 may be employed during assembly which is preferably a self-cutting thread for producing a mating thread in the longitudinal bore 26 of a counter-element 22, 122 made, for example, of plastic.

As an alternative to external thread 28, a snap-in connection may be established by providing wedge-shaped annular protrusions or extensions (not shown in these figures) on connecting element 30 which ensure that the connecting element 30 can be pressed into longitudinal bore 26 of counter-element 22, 122 but cannot be pulled out of it.

The counter-element 22 shown in FIG. 1 is connected in one piece with housing cover 12, thus creating an easily manufactured injection-molded component, preferably of plastic.

In a variation shown in FIG. 2, the counter-element 122 may be made of metal and may be connected in a form-locking manner with a cardboard or plastic cover 120. To establish this connection, counter-element 122 is provided with a radial flange or lateral extension 124 which rests in a recess 131 provided in the exterior surface of cover 120. In the same manner, screw 30 is also provided with a radial flange or lateral extension 29, which lies in a recess 31 disposed on the exterior of the associated housing cover 14.

Between each extension 29, 124 and the associated housing cover 14, 120, there is disposed a respective sealing element 32, 126. As shown in FIG. 6, these sealing elements are provided in the form of O-rings and may be composed, for example, of a rubber or rubber substrate material such as sold under the trademark Perbunan.

As shown in FIGS. 4, 5 and 6, means 34, 46, 47 for tightening the screw connection are provided on the exterior of counter-element 22 or of the cover connected with counter-element 22, respectively, as well as on screw 30. For example, a bore 44, 144 in counter-element 22, 122 provided for balancing the mass of bomblet 10, 100 (FIGS. 1 and 2) may be configured on its exterior to have the internal hexagon key slot shown in FIG. 4 or a slot 47 as shown in FIG. 5.

For the assembly process, the transverse bores 24 of counter-element 22, 122 are covered with thin sheets 48 (FIG. 3). FIG. 3 also shows that the internal bore 26 is provided with a passage 27 required for introduction of, for example, a self-cutting screw 30.

FIG. 6 shows screw 30 in an enlarged view, with the exterior of screw 30 being provided with the above-described external thread 28 and the interior with a bore 50 which has a threaded extension 21 to accommodate the delayed ignition charge 20.

In order to ignite delayed ignition charge 20, the exterior of screw 30 is provided with a bore 35 which has a funnel shape. Extension 29 of screw 30 is provided with bores 34 for tightening screw 30.

FIGS. 7 and 8 show that grooves 36 for igniting the delayed ignition charge 20 are disposed on the exterior surface of housing cover 14 accommodating screw 30. These grooves extend radially at an angle $\beta$ relative to one another. The housing cover 14 is provided with axially extending cams 38 which are disposed on the lands 37 between grooves 36. These cams 38 are oriented toward the exterior and are also arranged at an angle $\beta$ relative to one another so as to equalize the play of bomblets 10, 100 when inserted into a carrier projectile.

Figure 9:
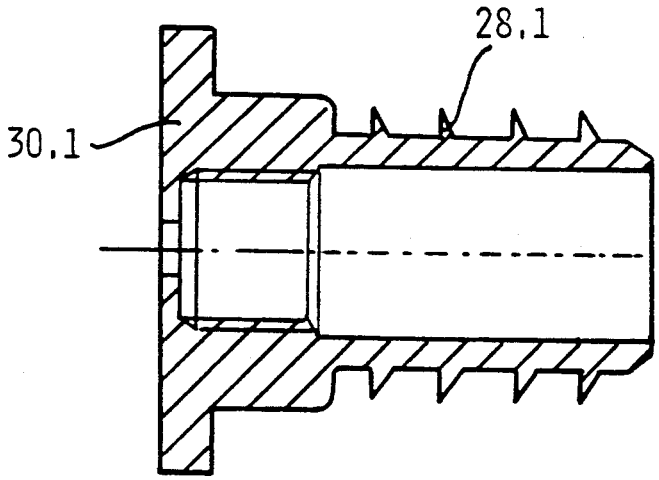
FIG. 9 is a longitudinal sectional view of a connecting element which functions as a snap insert instead of the screw shown on the base in FIG. 6.
Figure 10:
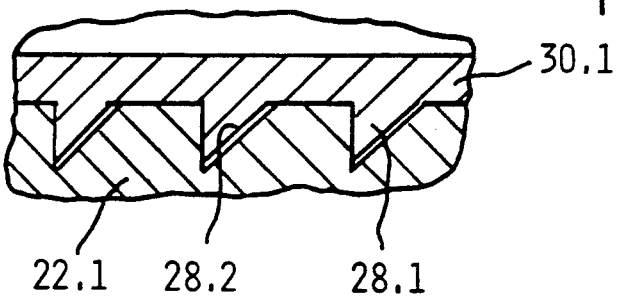
FIG. 10 is an enlarged detail of the snap-in connection made by the snap insert and the counter element.

FIG. 9 shows a snap insert 30.1 corresponding in its basic structure to the screw 30 shown in FIG. 6. However, in place of the thread 28, the insert 30.1 is provided with at least one and preferably a plurality of circumferential outwardly extending projections 28.1 disposed at equal distances from one another in the axial direction. The front surface of each of projections 28.1 slopes in the direction of insertion, i.e., rearwardly, for easy assembly, while the rear surface of each projection forms a radially extending plane for supporting the respective projections 28.1 in correspondingly shaped or mating circumferential grooves 28.2 in the inner surface of a counter element 22.1 as shown in FIG. 10.

It will be understood that the above description of the present invention is susceptible to various modifications, changes, and adaptations, and the same are intended to be comprehended within the meaning and range of equivalents of the appended claims.

What is claimed is:

1. A training bomblet comprising: a tubular housing shell formed of one of cardboard and plastic; first and second housing covers, each formed of one of cardboard and plastic, centered on and closing respective opposite ends of said tubular housing shell, said covers having respective abutment faces which contact respective end faces of said shell, with each said abutment face of said housing covers including a respective holding and sealing means which is pressed into a respective end face of said housing shell and comprises an annular blade member which has a cylindrical exterior surface extending substantially parallel to a longitudinal axis of said bomblet and a conical interior surface which tapers toward a cutting edge; a signature charge disposed in said shell and fixed at both end faces thereof by said covers; a delayed ignition charge accommodated by one of said housing covers; and a pretensioned connecting means for connecting said covers together and for pressing said abutment faces against respective said end faces of said tubular housing shell.

2. A training bomblet as defined in claim 1 wherein each said housing cover is provided with a respective projection which extends into and is centered by an interior bore of said tubular housing shell and which has an axial length which is longer than the axial length of the respective said blade member.

3. A training bomblet as defined in claim 1 wherein said connecting means comprises one of a screw and a snap-in connection disposed along the longitudinal axis of the bomblet.

4. A training bomblet comprising: a tubular housing shell formed of one of cardboard and plastic; first and second housing covers, each formed of one of cardboard and plastic, centered on and closing respective opposite ends of said tubular housing shell, said covers having respective abutment faces which contact respective end faces of said shell; a signature charge disposed in said shell and fixed at both end faces thereof by said covers; a delayed ignition charge accommodated by one of said housing covers; and a pretensioned connecting means for connecting said covers together and for pressing said abutment faces against respective said end faces of said tubular housing shell, said connecting means comprising one of a screw and a snap-in connection disposed along the longitudinal axis of the bomblet and including a connecting element connected to said first cover and having an axial bore for accommodating said delayed ignition charge, and a counter-element which is connected to said second cover and which includes a blind longitudinal bore extending from an end face to said counter-element facing said connecting element to, and opening onto, a transverse bore through said counter-element, said connecting element and said delayed ignition charge projecting into said blind longitudinal bore, with said connecting element engaging said counter-element and closing said blind bore at said end face of said counter-element.

5. A training bomblet as defined in claim 4 wherein each said abutment face of said housing covers includes a respective holding and sealing means which is at least pressed against a respective end face of said housing shell.

6. A training bomblet as defined in claim 5 wherein each said holding and sealing means is pressed into a respective said end face of said housing shell and comprises an annular blade member which has a cylindrical exterior surface extending substantially parallel to a longitudinal axis of said bomblet and a conical interior surface which tapers toward a cutting edge.

7. A training bomblet as defined in claim 16 wherein each said housing cover is provided with a respective projection which extends into and is centered by an interior bore of said tubular housing shell and which has an axial length which is longer than the axial length of the respective said blade member.

8. A training bomblet as defined in claim 4 wherein said connecting element is a screw which extends through an axial opening in said first cover.

9. A training bomblet as defined in claim 8 wherein said screw has a self-cutting external thread for connecting it with said counter-element.

10. A training bomblet as defined in claim 4 wherein said second cover and said counter-element are both made of plastic and are formed as one plastic piece.

11. A training bomblet as defined in claim 10 wherein said connecting element is a screw which extends through an axial opening in said first cover; and means for tightening the screw connection are provided on an exterior surface of said second cover and on said screw.

12. A training bomblet as defined in claim 4 wherein said counter-element is made of metal and is connected in a form-locking manner with said second cover.

13. A training bomblet as defined in claim 12 wherein said connecting element is a screw which extends through an axial opening in said first cover; and means for tightening the screw connection are provided on an exterior surface of said counter-element and of said screw.

14. A training bomblet as defined in claim 4 wherein: said connecting element and said counter-element extend through respective axial openings in said first and second covers, respectively and are each provided with a respective radial flange; each said first and second cover is provided on its exterior surface with a respective recess for accommodating said projection of said connecting element and of said counter-element, respectively; and a respective sealing element is disposed within each said recess between each said projection and the associated respective said housing cover.

15. A training bomblet as defined in claim 4 wherein radially extending grooves for igniting said delayed ignition charge are disposed in the exterior surface of said first housing cover.

16. A training bomblet as defined in claim 15 wherein said first housing cover is provided with a plurality of outwardly longitudinally oriented cams which are disposed on lands between said grooves.

17. A training bomblet as defined in claim 4 wherein: said connecting means is a snap-in connection with said connecting element comprising a screw-like member which extends through an axial opening in said first cover into said blind longitudinal bore of said counter element and which is provided with at least one outwardly extending circumferential projection, and with an inner surface of said counter element defining said blind longitudinal bore being provided with at least one circumferential groove for engaging said at least one circumferential projection.

18. A training bomblet as defined in claim 17 wherein said at least one circumferential projection and said at least one circumferential groove have mating shapes with said circumferential groove being defined by a radially extending surface and an inclined surface which extends from said radially extending surface to said inner surface of said counter element in a direction away from said end face of said counter element facing said connecting element.

* * * * *